US005165993A

United States Patent [19]

van Anholt et al.

[11] Patent Number: 5,165,993

[45] Date of Patent: Nov. 24, 1992

[54] AROMATIC POLYAMIDE YARN IMPREGNATED WITH LUBRICATING PARTICLES, A PROCESS FOR THE MANUFACTURE OF SUCH A YARN, AND PACKING MATERIAL OR ROPE CONTAINING THIS YARN

[75] Inventors: Willem C. van Anholt, Arnhem; Martinus W. M. G. Peters, Nijmegen, both of Netherlands

[73] Assignee: Akzo N.V., Arnhem, Netherlands

[21] Appl. No.: 657,038

[22] Filed: Feb. 19, 1991

Related U.S. Application Data

[63] Continuation of Ser. No. 427,927, Oct. 25, 1989, abandoned.

[30] Foreign Application Priority Data

Jul. 4, 1983 [NL] Netherlands ..... 8302368

[51] Int. Cl.[5] ..... D02G 3/00

[52] U.S. Cl. ..... 428/364; 428/372; 428/368; 428/369; 428/395; 57/250; 57/295; 57/350; 28/271; 28/219; 28/272; 28/165

[58] Field of Search ..... 57/250, 256, 295, 350; 428/372, 368, 364, 369, 399, 395; 28/271, 272, 165, 166, 219

[56] References Cited

U.S. PATENT DOCUMENTS

| | | | |
|---|---|---|---|
| 2,783,609 | 3/1957 | Breen | 57/246 |
| 3,110,151 | 11/1963 | Bunting, Jr. | 57/293 |
| 3,302,386 | 2/1967 | Gonsalves et al. | 57/351 |
| 3,339,357 | 9/1967 | Marzocchi et al. | 28/166 |
| 3,665,927 | 5/1972 | Kurtz | 428/372 |
| 3,844,195 | 10/1974 | Rhodes et al. | 57/250 |
| 4,100,725 | 7/1978 | Magel | 57/248 |
| 4,302,374 | 11/1981 | Helle et al. | 524/171 |
| 4,377,620 | 3/1983 | Alexander | 428/372 |
| 4,431,698 | 2/1984 | Case et al. | 57/258 |

*Primary Examiner*—Patrick J. Ryan
*Assistant Examiner*—N. Edwards
*Attorney, Agent, or Firm*—Louis A. Morris

[57] ABSTRACT

The invention relates to a filament yarn of aromatic polyamides which is impregnated with solid particles of a fluorine-containing polymer and/or graphite. The solid particles are incorporated into the yarn by very uniformly distributing them over the filaments in that the solid particles are applied to the yarn from an aqueous dispersion and the yarn is subjected to a blowing treatment while feeding them at an excess feed rate or not. The yarn thus impregnated is first of all intended to be processed into a packing material or rope.

12 Claims, 1 Drawing Sheet

AROMATIC POLYAMIDE YARN IMPREGNATED WITH LUBRICATING PARTICLES, A PROCESS FOR THE MANUFACTURE OF SUCH A YARN, AND PACKING MATERIAL OR ROPE CONTAINING THIS YARN

This is a continuation of application Ser. No. 07/427,927 filed Oct. 25, 1989, now abandoned.

The invention relates to a yarn made from wholly aromatic polyamides, which yarn is impregnated with a dispersion containing solid, lubricating particles, such as particles of fluorine-containing polymers and/or graphite. The invention also comprises a process for the manufacture of such yarn, and packing material, for instance stuffing box packing, containing said yarn.

A yarn of the type indicated above is known from U.S. Pat. No. 4,371,180, which describes packing composed of braided inorganic yarns, preferably of glass, and of braided organic yarns, preferably of polytetrafluoroethylene or wholly aromatic polyamides. Before or after being braided, the yarn may be impregnated with a dispersion of solid particles of a fluorine-containing polymer and starch. The dispersion containing polytetrafluoroethylene (PTFE) particles contributes considerably to the sealing properties of the endproduct in the form of packing material. Although the results obtained with the packing material disclosed in U.S. Pat. No. 4,371,180 are reasonable, the present invention makes it possible to improve on these results.

With that object in mind a yarn of the above type from wholly aromatic polyamides has been developed in the first place for use in packing material, which yarn is characterized according to the invention in that it is built up of a great many endless filaments on which the solid particles are present and over which the solid particles are distributed by subjecting the yarn to a blowing treatment in the wet state. In that process the filaments are generally entangled and interlaced. According to the invention the solid particles may consist of a fluorine-containing polymer, such as polytetrafluoroethylene or of graphite. Alternatively, however, use may be made of a mixture of solid particles of a fluorine-containing polymer and of graphite. The wet yarn subjected to a blowing treatment according to the invention has a voluminous character, which renders the yarn according to the invention particularly suitable for taking up a lubricant. Owing to its voluminous character the yarn will readily absorb a large amount of lubricant, which makes the yarn according to the invention particularly suitable to be formed into a packing material. As lubricants commonly used in the packing industry for impregnating yarns may be mentioned: paraffin oil, silicone oil or molybdenum disulphide or some other suitable lubricant, depending on the field of application of the packing to be manufactured. The invention comprises in particular a yarn which is so voluminous that the absorption capacity for a lubricant of the polyfluorocarbon particles-containing yarn is in the range of 20 to 50 per cent by weight, preferably in the order of 35 per cent by weight, calculated on the weight of the dry yarn provided with solid PTFE and/or graphite particles. The lubricant contributes considerably to the gas and/or liquid tightness and the frictional behaviour of a packing material. After being successively impregnated with PTFE particles, braided to form a packing material, and impregnated with a lubricating agent the aramid yarn according to the invention is capable of ensuring a long service life as far as high gas and/or liquid tightness and lubricating effect are concerned. According to the invention the yarn contains 1000 to 20 000 filaments, preferably about 5000 filaments, and the linear density of the yarn is in the range of tex 150 to 3000, preferably in the order of tex 850. According to the invention the yarn need contain only a relatively small proportion of solid PTFE and/or graphite particles, namely less than 60 per cent by weight, preferably 10–45% by weight, and more particularly about 20% by weight, calculated on the dry weight of the yarn without the solid particles. According to the invention the size of 80% of the solid particles is preferably in the range of about 0,1 to 1 μm. The yarn according to the invention is particularly characterized in that the solid particles are so evenly applied to the yarn that measured in a random cross-section of the yarn at least 50%, preferably 70% to 100% of the number of filaments are provided with one or more of said particles.

The special configuration of the yarn due to the wet-blowing process permits a particular uniform distribution of the PTFE particles over the cross-sectional area of the yarn. As a result, the function of the PTFE particles present in the yarn, i.e. promoting the sealing action of the packing material, is rendered most effective. Moreover, the PTFE particles enhance the chemical resistance of the packing material and reduce friction. The yarn according to the invention can therefore be formed into a packing material which ensures sufficient sealing over a long service time even under high dynamic loads, as in the case of high speed shafts or reciprocating parts in combination with elevated temperature and pressure and, possibly, a chemically agressive medium. Further, as a result of the uniform distribution of the PTFE particles over practically all the filaments of the yarn only a relatively small amount of PTFE particles is needed for this yarn of the present invention to be made into a satisfactorily sealing packing material. Another advantage of the uniform distribution of the PTFE particles in the yarn according to the invention consists in that the packing into which the yarn is braided need not be additionally impregnated with a PTFE particles-containing dispersion.

The yarn according to the invention has been especially developed and made suitable to be worked up into a packing material, such as stuffing box packing, which is widely used in machine construction for the sealing of rotating shafts and reciprocating parts. In the manufacture of packing material a number of yarns of the invention impregnated with PTFE and/or graphite particles can be braided together on a packing braiding machine to form a packing material which may for instance have a rectangular cross-section. The braided packing material is generally impregnated with a lubricating agent, such as a special oil, fat or other substances required in view of the use of the packing material. In the completed packing material according to the invention the proportion by weight of solid particles, calculated on the dry weight of the aramid yarn without solid particles, may be lower than 60%, and is preferably 10 to 45%. The invention particularly comprises a packing material of aromatic polyamide yarn impregnated with solid PTFE and/or graphite particles, which packing material is characterized in that it contains a fairly large amount of said lubricating agent, viz. an amount of 20 to 50% by weight, preferably about 25% by weight, calculated on the weight of the dry yarn provided with solid particles.

A simple and effective method of manufacturing the yarn according to the invention, comprising the application to the yarn of a dispersion of solid particles of a fluorine-containing polymer and/or graphite, is characterized in that whilst in the wet state the yarn is subjected to a blowing process using a fluid under pressure, such as air, as a result of which the solid particles are distributed over the filaments and the filaments are generally inter-entangled and braided. According to a preferred embodiment of the process according to the invention the yarn is subjected to a blowing process after the dispersion of solid particles of a fluorine-containing polymer and/or graphite particles-containing dispersion has been applied to the yarn. Alternatively, according to the invention, the dispersion of particles of a fluorine-containing polymer and/or graphite may be directly blown onto the yarn while being fed to it under pressure. In the blowing process air is used at an absolute pressure of 3 to 10 bar.

According to a preferred embodiment of the process of the present invention the, preferably positively charged, PTFE are applied to the yarn from an aqueous dispersion whose composition may substantially be as follows:

45 to 75% by weight of PTFE particles, preferably about 58% by weight;

50 to 20% by weight of water, preferably about 40% by weight;

not more than 5% by weight of a wetting agent based on alkylphenoxyethanol, preferably about 3,5% by weight.

The graphite particles are also applied from an aqueous dispersion, which may contain, for instance, about 18% by weight of graphite and 82% by weight of water and a nonionic wetting agent.

Particularly favourable results may be obtained when the PTFE and/or graphite particles are applied to the yarn from said dispersion with the aid of a kiss roll. Optionally, the PTFE and/or graphite particles may be applied to the yarn by passing it through a bath of said dispersion.

According to the invention the yarn is fed to the blowing process at a rate in excess of that at which it is withdrawn therefrom of at least 1%, preferably about 3% to 6%. According to the invention, however, a satisfactory distribution of the solid particles over practically all the filaments of the yarn also may be obtained when the yarn is subjected to the blowing process without using an excess feed rate. In the process in which no excess feed rate is used the yarn may be passed through the blowing zone practically without any tension. Furthermore, the yarn according to the invention is particularly suitable to be used in the manufacture of rope having an outer diameter of, for example 3 to 100 mm, such as marine rope, hoisting rope and the like, which rope is built up of two or more strands by laying or braiding. According to the invention the yarn to be incorporated in such rope contains less than 10% by weight, preferably about 5% by weight of solid particles.

The invention will be illustrated with reference to the accompanying schematic drawing.

Figure 1:
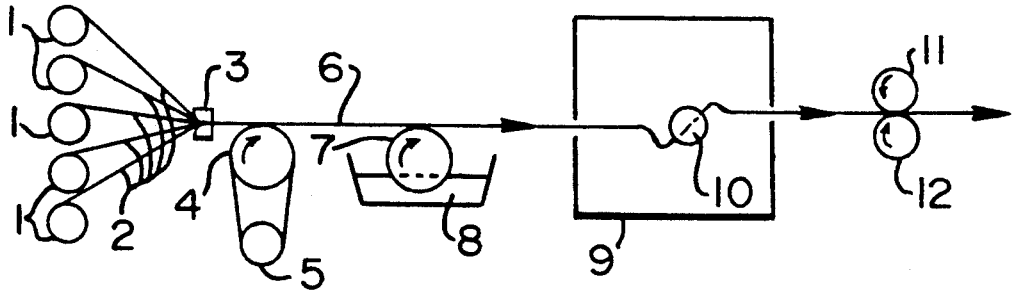
FIG. 1 shows an apparatus for applying PTFE particles to the yarn before the blowing process.

In the embodiment shown in FIG. 1 the process is started from 5 packages 1 of non-twisted aramid filament yarn. The aramid yarn 2 of each of the packages has 1000 filaments and a linear density of tex 168 and contains about 0,8% of a finish applied to the yarn during spinning. The five aramid filament yarns 2 are assembled by the schematically indicated yarn guide 3 and drawn off from the starting packages 1 by the driven rolls 4,5. The assembled yarn is subsequently run over the kissing roll 7 rotating in an aqueous dispersion 8. The assembled filament yarn thus wetted and provided with PTFE and/or graphite particles is fed to a blow box 9 containing an air nozzle 10 at a rate in excess of the rate at which it is withdrawn from the blow box. The nozzle 10 may be of the type as indicated in U.S. Pat. No. 3,302,386. The blown and impregnated yarn is discharged from the blow box 9 over a pair of driven pulling-off rolls 11,12 which have such a lower circumferential speed than the feed rolls 4,5 as to ensure that the yarn is fed to the air nozzle 10 at a sufficiently high excess feed rate. After leaving the heated pulling-off rolls 11,12 the dried yarn may still be lubricated, if desired, and subsequently wound into a package. In the blow box 9 the assembled yarn 5×168 composed of 5 basic yarns 2 is treated with air at an absolute pressure of 5 bar, the yarn being fed at an excess rate of 3%. Alternatively, the assembled yarn may be made up of 10 basic yarns. Such assembled 10×168 tex yarn is treated in the blow box 9 with air fed at an absolute pressure of 10 bar, the excess feed rate of the yarn being 60%. When the yarn is treated without applying an excess feed rate, it may be fed to and discharged from the blowing zone at a speed of 60 min/min.

Figure 2:
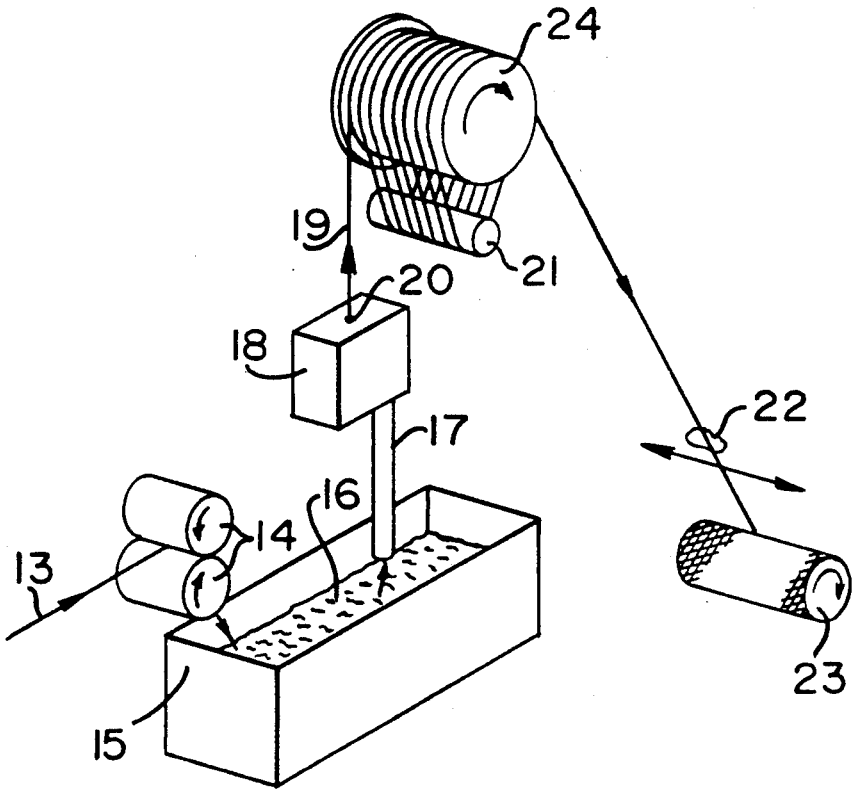
FIG. 2 shows a somewhat modified apparatus for carrying out the process of the invention.

FIG. 2 shows a somewhat modified embodiment of the apparatus for carrying out the process according to the invention. The untreated aramid yarn 13 is fed by a pair of rolls 14 at a particular speed desired. After leaving the rolls 14 the yarn is passed through a bath 15 containing an aqueous dispersion of PTFE and/or graphite particles. In the bath the yarn is passed over two or more guide rolls (not shown in the drawing). After leaving the bath 15 the yarn passes upwards through a feed pipe 17 ending in a blow box 18. In the blow box 18 there is again a nozzle (not shown) of the type described in U.S. Pat. No. 3,302,386. The advantage of the feed pipe 17 is that excess dispersion not entrained by the yarn and blown off from the yarn flows back into the bath through said pipe 17. After having been subjected to the blowing treatment, the impregnated yarn 19 leaves the blow box 18 through the outlet opening 20. The yarn is withdrawn from the blow box 18 by the driven roll 24 with separator roll 21. The roll 24 may be heated for drying the yarn. The yarn thus impregnated and dried may be formed into a package via a traverse mechanism 22. The circumferential speed of the roll 24 is lower than that of the rolls 14, so that the yarn is passed through the blow box at the particular excess feed rate desired.

It has been found that with the process given in FIG. 1 favourable results may be obtained, i.e., viewed in cross-section of the yarn the PTFE particles are very uniformly distributed over practically all the filaments mainly under the following process conditions:

circumferential speed of the kissing roll: 42 m/min;

circumferential speed of the rolls 4,5: 59,5 m/min (yarn feed rate);

circumferential speed of the rolls 11,12: 58 m/min (yarn discharge rate);

overfeed of the yarn at the nozzle: $\frac{59,5 - 58}{58} \cdot 100\% = 2,5\%$ absolute pressure of the blow air: 3 to 4 bar;

composition of dispersion: 56,5% by weight of PTFE particles, 40% by weight of water and 3,5% by weight of wetting agent of the Triton X 100 type, which is a commercially available wetting agent based on alkylphenoxy ethanol.

The dispersion used is of the type marketed by ICI under the name Fluon; the PTFE particles in it carry a negative electric charge. In the process of the invention, however, also other dispersions may be applied. Use may advantageously be made of dispersions in which the particles of the fluorocarbon compound, more particularly polytetrafluoroethylene (PTFE), carry a positive electric charge. These last-mentioned dispersions are elaborately described in DE 26 44 152. Use of a dispersion containing positively charged PTFE particles is expected to lead to an even better adhesion of these particles to the filaments of the yarn.

It should be added that the excess feed rate used in the wet-blowing process of the present invention is of great influence on the structure of the yarn. Particularly the interentanglement or interlacement of the filaments is very much dependent on the excess feed rate. At an the excess feed rate of as low as 1% the non-twisted yarn loses its smooth appearance and becomes somewhat bulky or textured as a result of the interentanglement and/or interlacement of the filaments and the formation of loops in one or more filaments. The interentanglement and interlacement of the filaments of a yarn and the manufacture of a yarn having a multitude of loops are known in themselves from the textile art and are described in U.S. Pat. No. 3,302,386 and U.S. Pat. No. 2,783,609. The interentanglement and interlacement of the filaments of a yarn with the aid of a blowing process and using an excess feed rate of the yarn imparts a voluminous character to the yarn. A high excess feed rate renders the yarn very bulky. The yarn wetted with a PTFE and/or graphite dispersion and subjected to a blowing treatment has a voluminous character, which is influenced by the degree of impregnation with solid particles. Impregnation of the yarn with a higher percentage of PTFE particles is attended with a lower voluminous character as a result of the adhesion of the PTFE particles to the yarn; in other words, the degree of impregnation to be chosen depends on the voluminous character desired.

In the manufacture of the yarn according to the invention the preferred excess feed rate is in the range of 3% to 6%, which results in a yarn having a more or less loopy character. The presence of internal and/or external loops formed in one or more filaments of the yarn and the resulting bulky appearance is characteristic of a particular embodiment of the yarn according to the invention. Particularly surprising is that already a fairly low excess feed rate of 3% results in a sufficiently voluminous yarn which is excellently suitable to be further processed into a packing material. However, even in the case of a yarn subjected to a blowing process without using an excess feed rate a particularly uniform distribution of the PTFE and/or graphite particles over practically all the filaments of the yarn is obtained. The blowing process constitutes an essential element of the invention with a view to obtaining a very good distribution of the solid particles over the filaments of the yarn.

Also a smooth, non-air blown aramid filament yarn can be treated with a PTFE particles-containing dispersion, use being made of an applicator roll or impregnation. Experiments, however, have demonstrated that in that case the PTFE particles will stick to the outer circumference of the yarn in the form of variously sized lumps, as can be seen on a highly enlarged photograph of a cross-section of the yarn. Such a photograph also shows that hardly any PTFE particles at all are stuck to the filaments that are within the circumference of the yarn. Therefore, a non-air treated aramid filament yarn cannot be evenly impregnated with PTFE particles and is less suitable to be worked up into a packing material.

The afore-mentioned absorption capacity of the yarn mentioned hereinbefore with regard to lubricants, such a paraffin oil, silicone oil, molybdenum disulphide or the like is referred to as oil absorption capacity and is determined as follows: An one meter long piece of aramid filament yarn impregnated beforehand with PTFE particles is impregnated with paraffin oil having a viscosity of 72 centipoises (measured by the Brookfield method) by dipping the yarn in a tray with paraffin oil at room temperature, after which the tray is kept in a vacuum chamber for 15 minutes. The yarn thus impregnated is suspended by its one end in such a way that the paraffin oil which cannot be retained by the yarn can drip off at its other, free end. The amount of paraffin oil absorbed, which is a measure of said oil absorption capacity, is determined by weighing. The second weighing of the oil-impregnated yarn is carried out as soon as there can no longer be observed any dripping at the free end of the yarn after at least 24 hours. To determine the oil absorption capacity the first weighing is carried out on said 1 m long piece of yarn while still dry and impregnated with PTFE and/or graphite particles.

Assume the result of the first weighing to be A units of weight (=dry yarn+PTFE and/or graphite particles).

Assume the result of the second weighing to be B units of weight (=dry yarn+PTFE and/or graphite particles+paraffin oil). The oil absorption capacity C envisaged in accordance with the invention can be calculated then from the formula $$C\,\% = \frac{B - A}{A} \cdot 100\%.$$

If the results A and B of the first and the second weighings are, for instance, 1000 and 1350 weight units, respectively, then $$C = \frac{1350 - 1000}{1000} \cdot 100\% = 35 \text{ weight } \%.$$

It should be added that by dry aromatic polyamide yarn mentioned in various places in the description is to be understood an aramid yarn which is dried at 100° C. to a moisture content of 6% by weight. Said moisture content is defined at 20° C. and 65% relative humidity.

The term wholly aromatic polyamides as used with regard to the present invention refers to polyamides which are entirely or substantially built up of recurrent units of the general formula $$-\underset{\underset{O}{\|}}{C}-A_1-\underset{\underset{O}{\|}}{C}-,\ -\underset{\underset{H}{|}}{N_2}-A_2-\underset{\underset{H}{|}}{N}- \text{ and/or } -\underset{\underset{O}{\|}}{C}-A_3-\underset{\underset{H}{|}}{N}-$$

wherein $A_1$, $A_2$ and $A_3$ represent different or the same divalent, one or more aromatic rings-containing rigid radicals which may also contain a heterocyclic ring, of which radicals the chain extending bonds are in the position para to each other or are parallel and oppositely directed. Examples of these radicals include 1,4-phenylene, 4,4'-biphenylene, 1,5-naphthylene and 2,6-naphthylene.

They may contain substituents or not, e.g. halogen atoms or alkyl groups. As regards the composition of the aramids it should be added that they may optionally contain up to 35 mole % of other groups, such as m-phenylene groups, non-rigid groups, such as alkyl groups, or ether groups, urea groups or ester groups. As examples of aramids may be mentioned poly-p-benzamide, poly-p-phenylene terephthalamide and their copolymers. According to the invention it is preferred that use should be made of yarns of poly-p-phenylene terephthalamide (PPDT).

Of the fluorine-containing compounds that may advantageously be used for the yarn according to the invention may be mentioned: polytetrafluoroethylene (PTFE), polyhexafluoropropylene, polychlorotrifluoroethene, polyvinylidene fluoride, tetrafluoroethene hexafluoropropylene copolymer, vinylidene fluoride-hexafluoropropylene copolymer, fluorosilicone elastomers, polyfluoroaniline, tetrafluoroethene trifluoronitrosomethane copolymer, graphite fluoride, etc.

It should be added that DE 23 26 826 describes a blended yarn consisting of 50–80% by weight of PTFE filaments and 50–20% by weight of aromatic polyamide filaments. Said blended yarn is coated with fine PTFE particles and may in the braided form be used as packing material. Before these two yarns are coated with PTFE particles, they must be assembled, which may optionally be effected by the blowing process described in U.S. Pat. 3,110,151. This blowing process results in a smooth yarn free of loops and therefore not bulky or textured. Coating such a yarn with PTFE particles will consequently result in these particles being practically entirely present on the outside of the yarn. Further, considering that the yarn according to DE 23 26 826 is a blend of two yarns having widely different properties, it is less homogeneous than a yarn of one and the same material.

Reference is also made to EP 0 032 744, which discloses a wholly aromatic polyamide yarn provided with a fluoro compounds-containing polymer. In that case the fluoro compound is not present on the fibres in the form of separate particles, but in the form of a continuous coating. As the PTFE is not present then on the fibres in the form of separate particles, this known yarn is not suitable to be used as packing yarn.

Further reference is made to CA 995 288 describing a hovercraft skirt containing an elastomer coated fabric composed of looped yarn textured by air under pressure, which yarns preferably consist of wholly aromatic polyamides. Therefore, looped yarns of aramids textured under air pressure are known in themselves from CA 995 288, but their field of application is entirely different and they are not at all meant to be used in combination with PTFE particles.

Within the scope of the invention various modifications may be made.

We claim:

1. A packing yarn built up of interlaced endless filaments, which yarn is impregnated with a dispersion comprising solid particles selected from the group consisting of fluorine-containing polymer particles and graphite particles, wherein such filaments consist essentially of wholly aromatic polyamide filaments, and wherein the solid particles are distributed over said filaments at the same time the interlacing of the filaments is effected by subjecting the yarn and dispersion to a blowing process while in the wet state, said yarn being fed to the blowing process at a rate in excess of that at which it is withdrawn therefrom, said dispersion being directly applied to the filaments of the yarn in said blowing process by being blown onto said filaments under pressure.

2. A yarn according to claim 1, wherein the yarn contains 1000 to 20,000 filaments and the linear density of the yarn is in the range of tex 150 to 3000.

3. A yarn according to claim 1, wherein the yarn contains less than 60% by weight of solid particles, calculated on the weight of the dry yarn without solid particles.

4. A yarn according to claim 3, wherein yarn contains 10 to 45% by weight of solid particles, calculated on the dry weight of the yarn without solid particles.

5. A yarn according to claim 1, wherein the size of 80% of the solid particles is less than 1 μm.

6. A yarn according to claim 1, wherein the solid particles are so evenly applied to the yarn that measured in a random cross-section of the yarn 50 to 100% of the number of filaments are provided with one or more of said particles.

7. A yarn according to claim 1, wherein it has loops formed in one or more filaments.

8. A yarn according to claim 1, wherein the yarn has both internal loops and loops projecting from it.

9. A yarn according to claim 1, wherein the yarn is so structured that the absorption capacity for a lubricant of the solid particles-containing yarn is in the range of 20 to 50% by weight calculated on the weight of the dry yarn provided with solid particles.

10. A packing yarn according to claim 1, wherein the yarn blowing treatment is effected by a fluid-jet process.

11. A packing yarn as defined in claim 1, wherein the polyfluorocarbon resin is PTFE.

12. A packing yarn as defined in claim 1, wherein the solid lubricating particles include particles of graphite.

* * * * *